US008469795B2

(12) United States Patent
Langille

(10) Patent No.: US 8,469,795 B2
(45) Date of Patent: Jun. 25, 2013

(54) METHOD OF GAMING AND A GAMING SYSTEM

(75) Inventor: Jamie K. Langille, Las Vegas, NV (US)

(73) Assignee: Aristocrat Technologies Australia Pty Limited (AU)

( * ) Notice: Subject to any disclaimer, the term of this patent is extended or adjusted under 35 U.S.C. 154(b) by 436 days.

(21) Appl. No.: 12/435,150

(22) Filed: May 4, 2009

(65) Prior Publication Data

US 2009/0275391 A1 Nov. 5, 2009

Related U.S. Application Data

(60) Provisional application No. 61/050,418, filed on May 5, 2008, provisional application No. 61/079,657, filed on Jul. 10, 2008.

(51) Int. Cl.
*A63F 9/24* (2006.01)

(52) U.S. Cl.
USPC ..... 463/20

(58) Field of Classification Search
USPC ..... 463/20
See application file for complete search history.

(56) References Cited

U.S. PATENT DOCUMENTS

| | | | | |
|---|---|---|---|---|
| 6,475,087 | B1 | 11/2002 | Cole | |
| 6,572,204 | B1 | 6/2003 | Hedrick | |
| 2003/0216167 | A1 | 11/2003 | Gauselmann | |
| 2004/0053699 | A1 | 3/2004 | Rasmussen | |
| 2004/0214635 | A1 | 10/2004 | Orada | |
| 2005/0009596 | A1 | 1/2005 | Daly | |
| 2005/0233795 | A1 | 10/2005 | Wolf | |
| 2005/0282607 | A1* | 12/2005 | Gauselmann | 463/16 |
| 2006/0040728 | A1 | 2/2006 | Fuller | |
| 2007/0010316 | A1* | 1/2007 | Baerlocher et al. | 463/20 |
| 2007/0060298 | A1 | 3/2007 | Vallejo | |
| 2007/0155474 | A1 | 7/2007 | Gauselmann | |
| 2007/0197300 | A1 | 8/2007 | Cotner | |
| 2007/0232380 | A1 | 10/2007 | Vallejo | |
| 2007/0298880 | A1 | 12/2007 | Rasmussen | |
| 2009/0305770 | A1* | 12/2009 | Bennett et al. | 463/20 |

FOREIGN PATENT DOCUMENTS

| | | |
|---|---|---|
| CA | 2249791 | 4/1999 |
| CA | 2531807 | 2/2005 |
| CA | 2566785 | 5/2007 |
| EP | 1475759 | 11/2004 |
| EP | 1505548 | 2/2005 |
| EP | 1530176 | 5/2005 |
| GB | 2385701 | 8/2003 |
| GB | 2389694 | 12/2003 |
| GB | 2429102 | 2/2007 |
| WO | 2006009658 | 1/2006 |
| WO | 2006078670 A2 | 7/2006 |

* cited by examiner

*Primary Examiner* — William D Coleman
*Assistant Examiner* — Christine Enad
(74) *Attorney, Agent, or Firm* — McAndrews, Held & Malloy, Ltd.

(57) ABSTRACT

A method of gaming comprising: conducting at least one first game round, each first game round comprising selecting symbols of a plurality of normal first reels for display and evaluating the selected symbols; and conducting at least one second game round in response to a trigger event occurring, each second game round comprising fewer reels than in each first game round and being conducted by selecting symbols of at least one second reel for display and evaluating the selected symbols.

37 Claims, 7 Drawing Sheets

METHOD OF GAMING AND A GAMING SYSTEM

RELATED APPLICATIONS

This application claims priority to U.S. Provisional Patent Application Nos. 61/050,418 having a filing date of May 5, 2008 and 61/079,657 having a filing date of Jul. 10, 2008, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to a method of gaming and a gaming system.

Current gaming machines employ a fixed number of reels. While such gaming systems provide users with enjoyment, a need exists for alternative gaming systems in order to maintain or increase player enjoyment.

BRIEF SUMMARY OF THE INVENTION

In a first aspect, the invention provides a method of gaming comprising:

conducting at least one first game round, each first game round comprising selecting symbols of a plurality of normal first reels for display and evaluating the selected symbols; and conducting at least one second game round in response to a trigger event occurring, each second game round comprising fewer reels than in each first game round and being conducted by selecting symbols of at least one second reel for display and evaluating the selected symbols.

In an embodiment, the method comprises removing at least one reel from the set of first reels in response to the trigger event occurring such that each second reel corresponds to one of the first reels.

In an embodiment, the method comprises substituting the at least one second reel for the plurality of first reels in response to the trigger event occurring, each second reel different to the first reel.

In an embodiment, the method comprises conducting a plurality of second game rounds.

In an embodiment, the method comprises varying the number of second reels during the plurality of second game rounds.

In an embodiment, the method comprises conducting each first game round with five reels.

In an embodiment, the method comprises conducting at least one second game round with three reels.

In an embodiment, the method comprises conducting at least one second game round with one reel.

In an embodiment, the method comprises conducting each first and second game round with a game controller.

In a second aspect, the invention provides a game controller for a gaming system, the game controller arranged to:

conduct at least one first game round, each first game round comprising selecting symbols of a plurality of normal first reels for display and evaluating the selected symbols; and conduct at least one second game round in response to a trigger event occurring, each second game round comprising fewer reels than in each first game round and being conducted by selecting symbols of at least one second reel for display and evaluating the selected symbols.

In an embodiment, the game controller comprises a trigger evaluator arranged to determine that a trigger event has occurred.

In an embodiment, the game controller comprises at least one symbol selector arranged to select symbols in the first and second game rounds.

In an embodiment, the game controller comprises a reel controller arranged to control the reels from which symbols are selected in at least each second game round.

In an embodiment, the game controller comprises at least one award evaluator arranged to evaluate selected symbols in the first and second game rounds.

In an embodiment, the game controller is constituted at least in part by a processor executing program code stored in a memory.

In an embodiment, the game controller is arranged to remove at least one reel from the set of first reels in response to the trigger event occurring such that each second reel corresponds to one of the first reels.

In an embodiment, the game controller is arranged to substitute the at least one second reel for the plurality of first reels in response to the trigger event occurring, each second reel different to the first reel.

In an embodiment, the game controller is arranged to conduct a plurality of second game rounds.

In an embodiment, the game controller is arranged to varying the number of second reels during the plurality of second game rounds.

In an embodiment, the game controller is arranged to conduct each first game round with five reels.

In an embodiment, the game controller is arranged to conduct at least one second game round with three reels.

In an embodiment, the game controller is arranged to conduct at least one second game round with one reel.

In a third aspect, the invention provides a gaming system comprising:

a display; and a game controller arranged to:

conduct at least one first game round, each first game round comprising selecting symbols of a plurality of normal first reels and evaluating the selected symbols; and conduct at least one second game round in response to a trigger event occurring, each second game round comprising fewer reels than in each first game round and being conducted by selecting symbols of at least one second reel for display and evaluating the selected symbols.

In an embodiment, the display forms part of a player interface further comprising a game play mechanism operable by the player to play the game.

In an embodiment, the game controller comprises a trigger evaluator arranged to determine that a trigger event has occurred.

In an embodiment, the game controller comprises at least one symbol selector arranged to select symbols in the first and second game rounds.

In an embodiment, the game controller comprises a reel controller arranged to control the reels from which symbols are selected in at least each second game round.

In an embodiment, the game controller comprises at least one award evaluator arranged to evaluate selected symbols in the first and second game rounds.

In an embodiment, the game controller comprises a processor executing program code stored in a memory.

In an embodiment, the game controller is arranged to remove at least one reel from the set of first reels in response to the trigger event occurring such that each second reel corresponds to one of the first reels.

In an embodiment, the game controller is arranged to substitute the at least one second reel for the plurality of first reels in response to the trigger event occurring, each second reel different to the first reel.

In an embodiment, the game controller is arranged to conduct a plurality of second game rounds.

In an embodiment, the game controller is arranged to varying the number of second reels during the plurality of second game rounds.

In an embodiment, the gaming system is arranged to conduct each first game round with five reels.

In an embodiment, the gaming system is arranged to conduct at least one second game round with three reels.

In an embodiment, the gaming system is arranged to conduct at least one second game round with one reel.

In a fourth aspect the invention provides a gaming system comprising:

display means for displaying game outcomes to a player; and means for conducting at least one first game round, each first game round comprising selecting symbols of a plurality of normal first reels for display;

means for evaluating the selected symbols of each first game round;

means for conducting at least one second game round in response to a trigger event occurring, each second game round comprising fewer reels than in each first game round and being conducted by selecting symbols of at least one second reel for display; and means for evaluating the selected symbols of each second game round.

In a fifth aspect, the invention provides a gaming machine comprising:

a cabinet;

a display mounted within the cabinet for displaying play of a game to a player; and at least one input device mounted to the cabinet at a position where the player can view the display while operating said at least one input device, said at least one input device operable to input an instruction to initiate a play of a game; and a game controller comprising a processor and a memory storing game instructions, the game controller in data communication with said at least one input device and operating in response receipt of the instruction to initiate a play to initiation of a play to conduct at least one first game round by selecting symbols of a plurality of normal first reels for display on the display and evaluating the selected symbols, and to conduct at least one second game round in response to a trigger event occurring, each second game round comprising fewer reels than in each first game round and being conducted by selecting symbols of at least one second reel for display on the display and evaluating the selected symbols.

In a sixth aspect, the invention provides computer program code which when executed implements the above method.

In a seventh aspect, the invention provides a computer readable medium comprising the above program code.

In an eight aspect, the invention provides a data signal comprising the above program code.

In a ninth aspect, the invention provides transmitting and receiving the above program code.

BRIEF DESCRIPTION OF SEVERAL VIEWS OF THE DRAWINGS

An exemplary embodiment of the invention will flow be described with reference to the accompanying drawings in which.

DETAILED DESCRIPTION OF THE INVENTION

Figure 1:
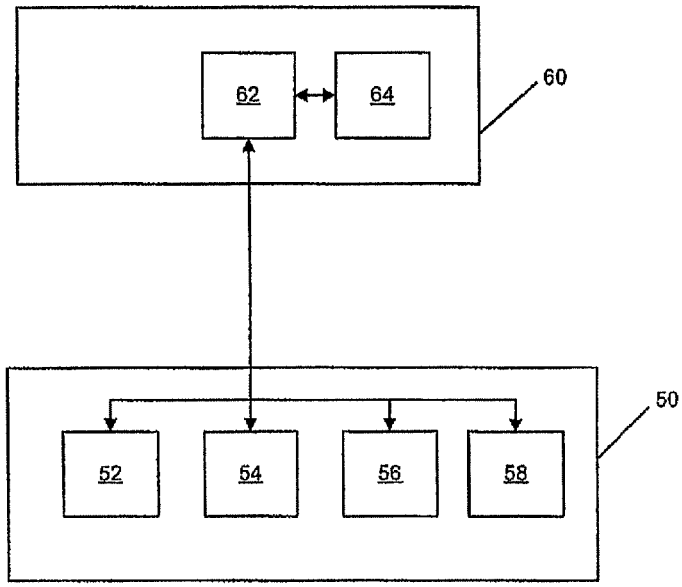
FIG. 1 is a block diagram of the core components of a gaming system.

Referring to the drawings, there is shown a gaming system having a game controller arranged to implement a game where initially a plurality of reels are spun in each game round but, if a trigger event occurs, at least one game round is carried out with a smaller number of reels.

Herein, the term "first game round" is used to refer to a game round conducted with a normal number of reels. A "second game round" is one in which the number of reels are reduced and the term may apply game round with varying numbers of reels provided they are less than in a first game round.

A game round involves at least one of the reels being "spun"—e.g. new symbols of the reels are selected for display at the display positions and the reel is either physically or virtually spun to a stop. Persons skilled in the art will appreciate that there may be more than one game round in a play of a gaming machine such as is the case when a series of free spins is awarded. The outcome of a game round may be no win, a win (for example from a winning combination of symbols), a contribution towards a win accrued over a plurality of game rounds, a trigger condition occurring etc.

General Construction of Gaming System

The gaming system can take a number of different forms. In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system comprises several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions and play the game.

Components of the player interface may vary from embodiment to embodiment but will typically include a credit mechanism 52 to enable a player to input credits and receive payouts, one or more displays 54, a game play mechanism 56 comprising one or more input devices that enable a player to input game play instructions (e.g. to place bets), and one or more speakers 58.

The game controller 60 is in data communication with the player interface and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

Figure 2:
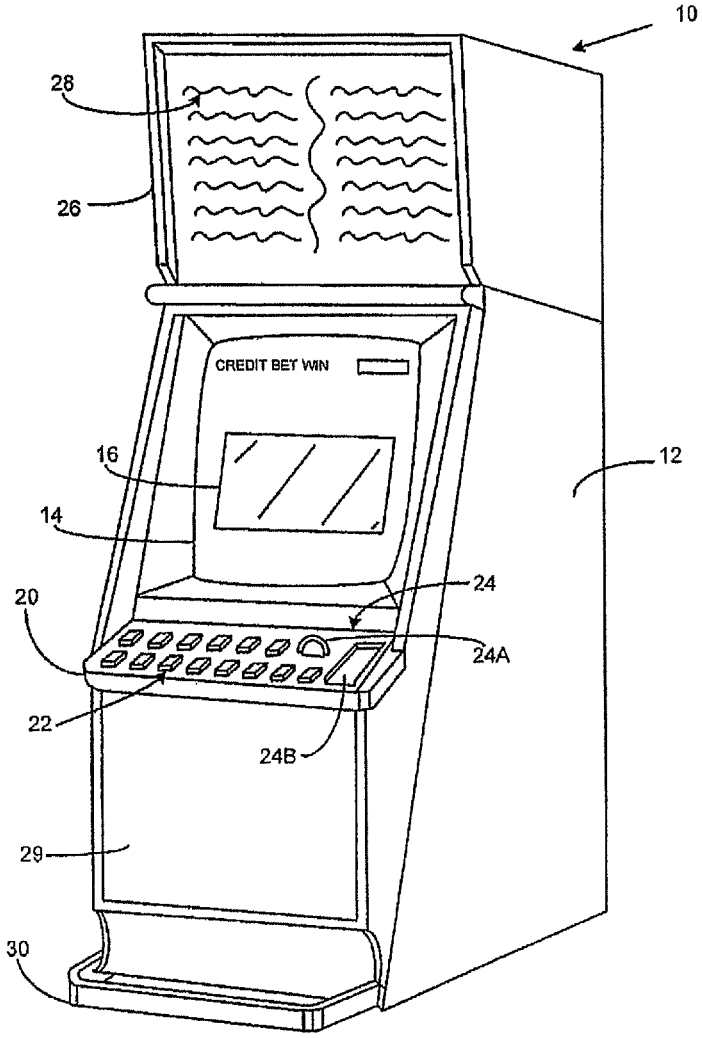
FIG. 2 is a perspective view of a stand alone gaming machine.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. A player marketing module (not shown) having a reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
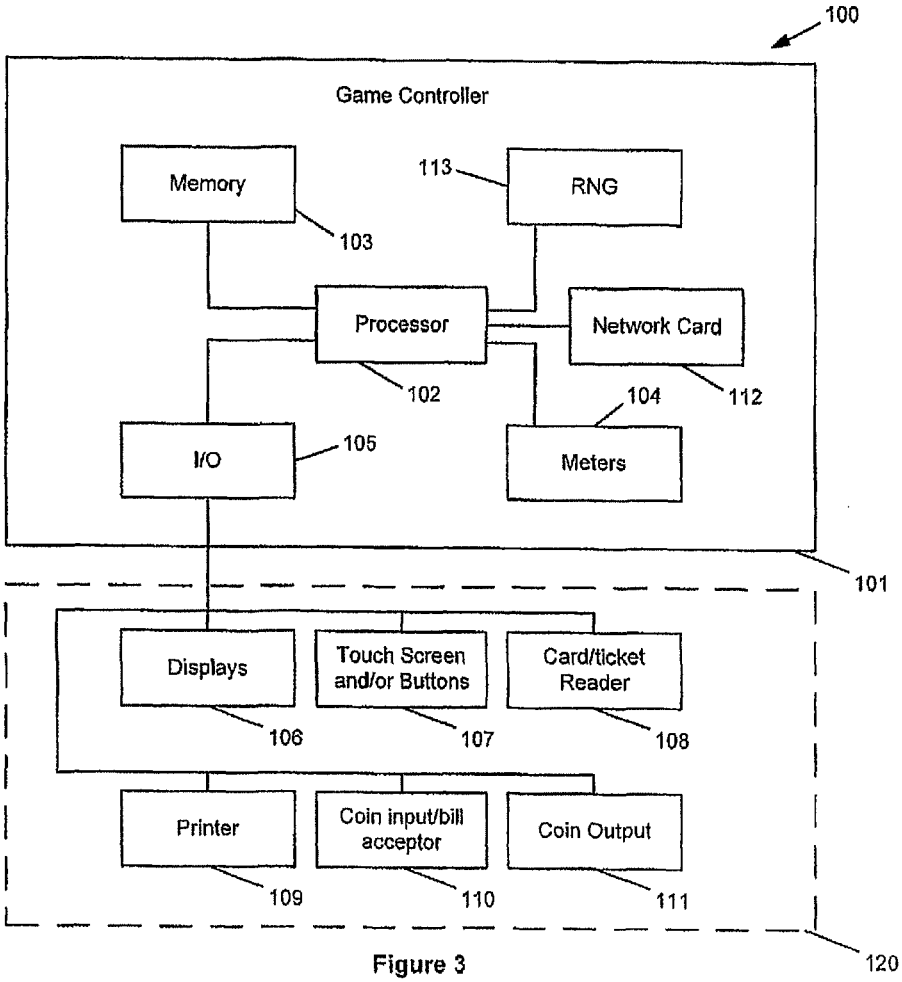
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 comprise one or more displays 106, a touch screen and/or buttons 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is uses to initiate a play of the game.

In addition, the gaming machine 100 may include a communications interface, for example a network card 112. The network card may, for example, send status information, accounting information or other information to a central controller, server or database and receive data or commands from the central controller, server or database.

Figure 4:
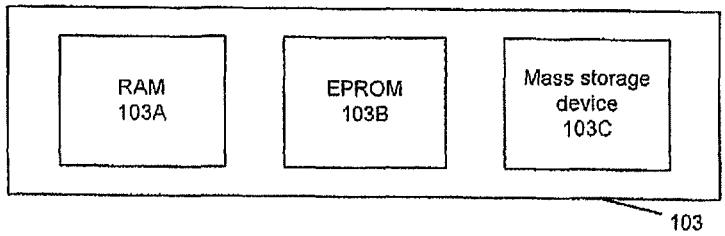
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
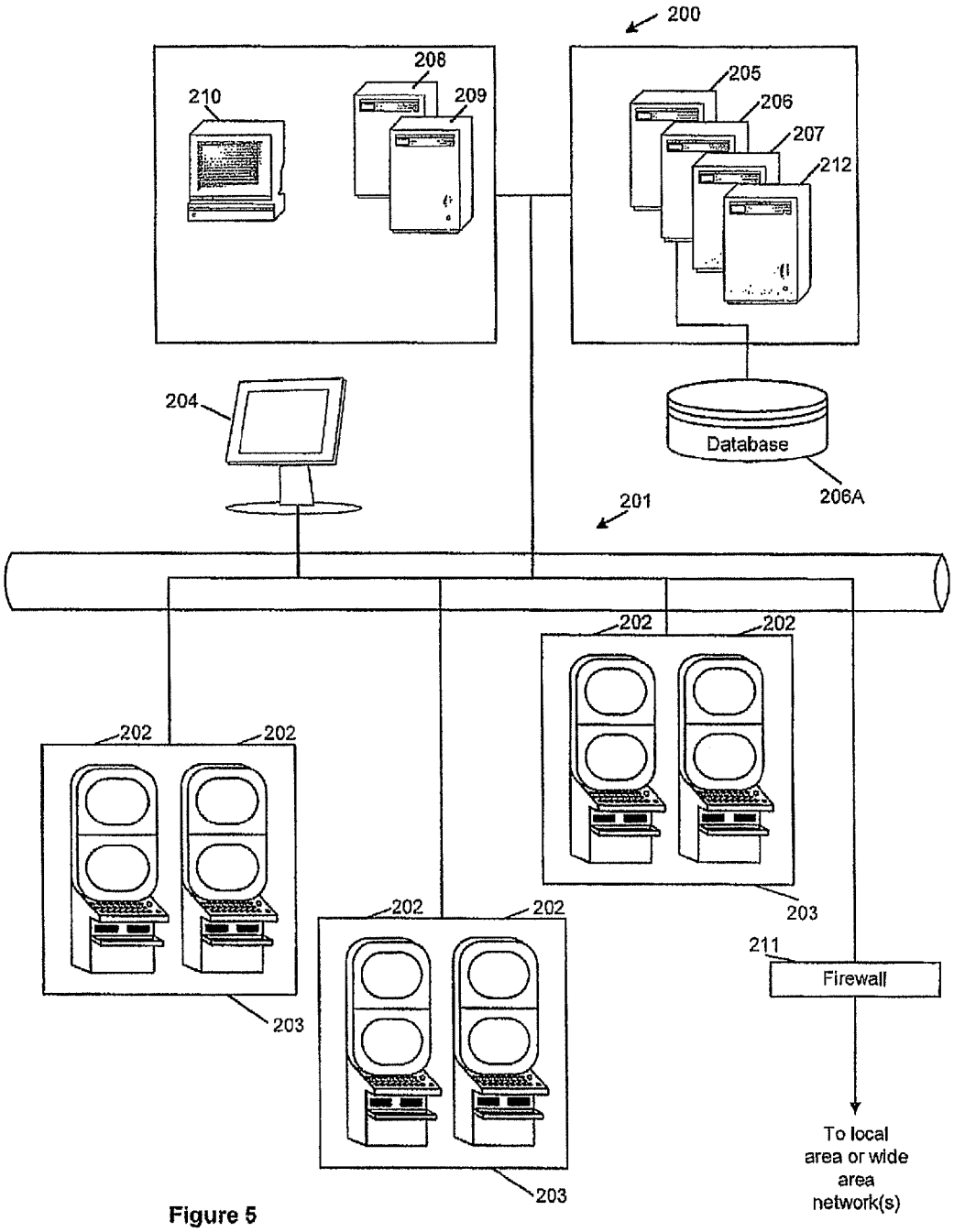
FIG. 5 is a schematic diagram of a network gaming system.
Figure 6:
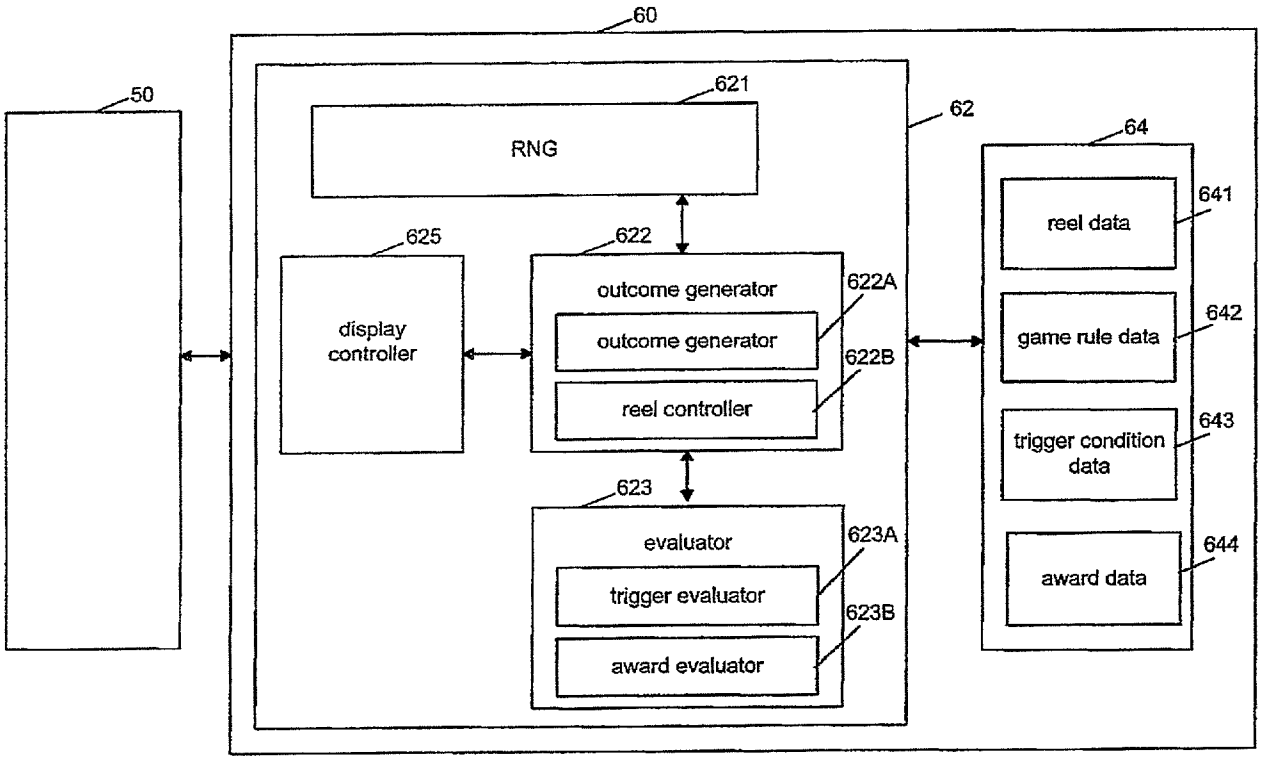
FIG. 6 is a further block diagram of a gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

The player operates game play mechanism 56 to establish the win entitlement which will be evaluated for this game. Persons skilled in the art will appreciate that a player's win entitlement will vary from game to game and may or may not be dependent on player selections. In most spinning reel games, it is typical for the player's entitlement to be affected by the amount they wager and selections they make (i.e. the nature of the wager). For example, a player's win entitlement may be based on how many lines they will play in each game—i.e. a minimum of one line up to the maximum number of lines allowed by the game (noting that not all permutations of win lines may be available for selection. Such win lines are typically formed by a combination of displayed symbol positions, one from each reel, the symbol positions being located relative to one another such that they form a line.

In many games, the player's win entitlement is not strictly limited to the lines they have selected, for example, "scatter" pays are awarded independently of a players selection of pay lines and are an inherent part of the win entitlement.

Persons skilled in the art, will appreciate that in other embodiments, the player may obtain a win entitlement by selecting a number of reels to play. Such games are marketed under the trade name "Reel Power" by Aristocrat Leisure Industries Pty Ltd. The selection of the reel means that each symbol of the reel can be substituted for a symbol at one or more designated display positions. In other words, all displayed symbol positions of a selected reel can be used to form symbol combinations with designated, displayed symbol positions of other reels.

In other embodiments a player win entitlement may be affected by purchasing access to particular pay tables—e.g. a first bet amount entitles the player to wins including cherries and a second amount entitles them to wins including plums. The win entitlement is not always purchased—e.g. a series of free games may be awarded.

In this embodiment, a series of modules are shown as implemented by processor 62 executing program code stored in memory 64. Persons skilled in the art will appreciate that in other embodiments, one or more modules could be implemented by a dedicated circuit.

The outcome generator 622 operates in response to the player's operation of game play mechanism 56 to conduct game rounds. Each game round involves selecting symbols of the reels employed for that game round which are evaluated by symbol evaluator 623. In a first game rounds, the symbol selector 622A selects symbols from sets of symbols corresponding to a plurality of reels specified by reel data 641. The selected symbols are advised to the display controller 624 which causes them to be displayed on display 54 at a set of display positions.

The reel data 641 specifies a sequence of symbols for each reel such that, in one exemplary embodiment, the symbol selector 622A can select the symbols to appear at the stopping positions by selecting a stopping position in the sequence employing random number generator 621. Such selection may be weighted as is known in the art. In one example, three symbols of each of five reels may be displayed such that symbols are displayed at fifteen display positions on display 54. Evaluator 623 evaluates the symbols for any awards 623A specified by award data 644 and, in this embodiment, to see whether any triggers 623B specified by trigger conditions 643 are met. In other embodiments, the trigger conditions may be independent of the symbols, for example, based on turnover or an external trigger from a connected bonusing system.

When a trigger condition is met, at least one second game round is conducted: for example a series of free second game rounds may be conducted. The reel controller 622B determines based on game rule data which reels are to be employed. In some embodiments, this will be a subset of the reels used in the first game rounds. In other embodiments a further set (or sets) of reels may be specified for use. The symbols comprising these reels are stored as reel data 641. The symbol selector 622A then selects symbols in the manner describe above and these are evaluated by evaluator 623. The awards that apply to this evaluation may be the same or different to those used in evaluation of the first game rounds. In one example, the pay table which applies to the first game rounds may also apply in the second game rounds but the player may only be required to obtain a starting portion of a combination to collect the prize. For example, if there is a prize for five a kind in the five reel first game round, the same prize might be awarded for three of a kind in a three reel second game round. Alternatively, different win lines or different win rules may apply in the second game rounds, for example a different pay table might apply.

The second game rounds continue until an end condition is met, for example a fixed number of free spins being exhausted. During the second game rounds, the number of reels may be reduced again, either in response to a further trigger event occurring or at a defined place in a free game sequence. For example, the number of reels could reduce first from five to three then from three to one.

Persons skilled in the art will appreciate that there could, for example be only one second game round. Further more, even if a second game round is awarded, an additional bet may be required before it proceeds. Further, an additional bet may be required for eligibility to obtain second game rounds. Other eligibility criteria known in the art may apply, for example, the player may be required to play a certain number of lines or place a certain sized bet to be eligible.

Persons skilled in the art will appreciate that in some embodiments the number of reels can decrease and increase dynamically a number of times. For example, there may be specific triggers which subtract or add reels. In one exemplary embodiment certain symbol combinations may result in subtraction of reels and others may result in addition of the reels. In some embodiments the total number of reels may at some stage exceed the initial number of reels. In some embodiments, the initial alteration of the reels is always a subtraction of reels.

Figure 7:
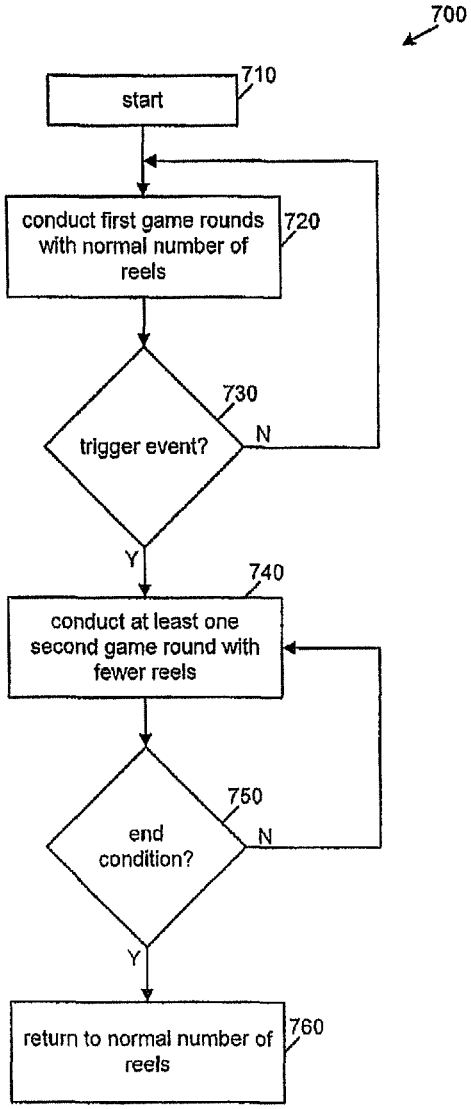
FIG. 7 is a flow chart of an embodiment.

The method 700 of an embodiment is summarized in FIG. 7. When the player starts 710 play of the game, play 720 is initially with the normal number of reels. The game controller 60 monitors 730 for the occurrence of a trigger event. When a trigger event occurs, at least one second game round is conducted 740 with fewer reels. The game controller 60 monitors 750 for an end condition. When the end condition occurs game play is returned 760 to a normal number of reels.

Persons skilled in the art will also appreciate that the method of the embodiment could be embodied in program code. The program code could be supplied in a number of ways, for example on a computer readable medium, such as a disc or a memory (for example, that could replace part of memory 103) or as a data signal which can be transmitted and received (for example, by downloading it from a server).

Example

Figure 8A:
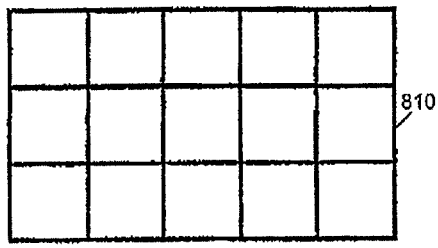
FIGS. 8A to 8D are exemplary reel displays of an example.
Figure 8B:
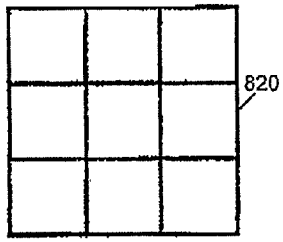
Figure 8C:
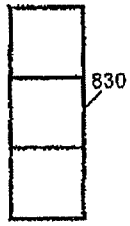
Figure 8D:
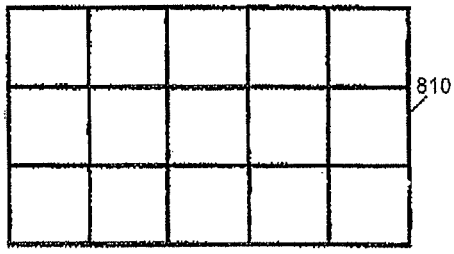

FIGS. 8A to 8D show an example where normal play is of a first game round is conducted in respect of five reels with three symbols of each reel displayed 810 as shown in FIG. 8A. In response to a first trigger event, second game rounds are initially conducted with three reels with three symbols of each reel displayed 820 as shown in FIG. 8B. The reels are a subset of the normal reels and prizes are awarded based on the symbol combinations corresponding to the initial portion of winning combination in the normal pay table (evaluated left to right). A plurality of second game rounds are conducted with display 820 until a second trigger event occurs and the display is reduced to a single reel 830 as shown in FIG. 8C. One game round is conducted in this mode during which the player will automatically win the highest prize which begins with the selected symbols. Game play then reverts to the normal display 810 as shown in FIG. 8D.

An advantage of embodiments of this invention is that it presents a game where a reduced number of reels in a second game round. A further advantage is that the player can have a dynamic reel display which changes based on the outcome of the game. A further advantage is that the number of reels can decrease from the normal number of reels more than once.

It will be understood to persons skilled in the art of the invention that many modifications may be made without departing from the spirit and scope of the invention, in particular it will be apparent that certain features of the above exemplary embodiments can be combined to form further embodiments.

It is to be understood that, if any prior art publication is referred to herein, such reference does not constitute an admission that the publication forms a part of the common general knowledge in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A method of gaming for use with a gaming system having a gaming controller, the method comprising:

conducting, via the gaming controller, at least one first game round, said conducting of the at least one first game round comprising selecting symbols for a plurality of first reels for display;

conducting, via the gaming controller, at least one second game round in response to a first trigger event occurring in the at least one first game round, wherein the at least one second game round has fewer reels displayed than in the at least one first game round, and wherein said conducting of the at least one second game round comprises selecting symbols for at least one second reel for display;

conducting, via the gaming controller, a further game round in response to a second trigger event occurring in the at least one second game round, wherein the further game round has a single reel displayed, and wherein said conducting of the further game round comprises selecting symbols for the single reel for display; and determining, via the gaming controller, prizes based on winning combinations formable with the symbols selected in the single reel of the further game round and awarding at least the highest of the determined prizes.

2. A method as claimed in claim 1, and further comprising removing at least one reel from the set of first reels in response to the trigger event occurring such that each second reel corresponds to one of the first reels.

3. A method as claimed in claim 1, and further comprising substituting the at least one second reel for the plurality of first reels in response to the trigger event occurring, each second reel different to the first reel.

4. A method as claimed in claim 1, and further comprising conducting a plurality of second game rounds.

5. A method as claimed in claim 4, and further comprising varying the number of second reels during the plurality of second game rounds.

6. A method as claimed in claim 1, and further comprising conducting each first game round with five reels.

7. A method as claimed in claim 1, and further comprising conducting at least one second game round with three reels.

8. A method as claimed in claim 1, and further comprising conducting at least one second game round with one reel.

9. A method as claimed in claim 1, and further comprising conducting each first and second game round with a game controller.

10. A game controller for a gaming system, the game controller arranged to:

conduct at least one first game round, said conducting of the at least one first game round comprising selecting symbols for a plurality of first reels for display;

conduct at least one second game round in response to a first trigger event occurring in the at least one first game round, wherein the at least one second game round has fewer reels displayed than in the at least one first game round, and wherein said conducting of the at least one second game round comprises selecting symbols for at least one second reel for display;

conduct a further game round in response to a second trigger event occurring in the at least one second game round, wherein the further game round has a single reel displayed, and wherein said conducting of the further game round comprises selecting symbols for the single reel for display; and determine prizes based on winning combinations formable with the symbols selected in the single reel of the further game round and award at least the highest of the determined prizes.

11. A game controller as claimed in claim 10, and further comprising a trigger evaluator arranged to determine that a trigger event has occurred.

12. A game controller as claimed in claim 10, and further comprising at least one symbol selector arranged to select symbols in the first and second game rounds.

13. A game controller as claimed in claim 10 and further comprising a reel controller arranged to control the reels from which symbols are selected in at least each second game round.

14. A game controller as claimed in claim 10 and further comprising at least one award evaluator arranged to evaluate selected symbols in the first and second game rounds.

15. A game controller as claimed in claim 10, and further arranged to remove at least one reel from the set of first reels in response to the trigger event occurring such that each second reel corresponds to one of the first reels.

16. A game controller as claimed in claim 10, and further arranged to substitute the at least one second reel for the plurality of first reels in response to the trigger event occurring, each second reel different to the first reel.

17. A game controller as claimed in claim 10, and further arranged to conduct a plurality of second game rounds.

18. A game controller as claimed in claim 17, and further arranged to varying the number of second reels during the plurality of second game rounds.

19. A game controller as claimed in claim 10, and further arranged to conduct each first game round with five reels.

20. A game controller as claimed in claim 10, and further arranged to conduct at least one second game round with three reels.

21. A game controller as claimed in claim 10, and further arranged to conduct at least one second game round with one reel.

22. A gaming system comprising:

a display; and a game controller arranged to:

conduct at least one first game round, said conducting of the at least one first game round comprising selecting symbols for a plurality of first reels;

conduct at least one second game round in response to a first trigger event occurring in the at least one first game round, wherein the at least one second game round has fewer reels displayed than in the at least one first game round, and wherein said conducting of the at least one second game round comprises selecting symbols for at least one second reel for display;

conduct a further game round in response to a second trigger event occurring in the at least one second game round, wherein the further game round has a single reel displayed, and wherein said conducting of the further game round comprises selecting symbols for the single reel for display; and determine prizes based on winning combinations formable with the symbols selected in the single reel of the further game round and awarding at least the highest of the determined prizes.

23. A gaming system as claimed in claimed in claim 22, and wherein the display forms part of a player interface further comprising a game play mechanism operable by the player to play the game.

24. A gaming system as claimed in claim 22 and wherein the game controller comprises a trigger evaluator arranged to determine that a trigger event has occurred.

25. A gaming system as claimed in claim 22, and wherein the game controller comprises at least one symbol selector arranged to select symbols in the first and second game rounds.

26. A gaming system as claimed in claim 22, and wherein the game controller comprises a reel controller arranged to control the reels from which symbols are selected in at least each second game round.

27. A gaming system as claimed in claim 22, and wherein the game controller comprises at least one award evaluator arranged to evaluate selected symbols in the first and second game rounds.

28. A gaming system as claimed in claim 22, and wherein the game controller comprises a processor executing program code stored in a memory.

29. A gaming system as claimed in claim 22, and wherein the game controller is arranged to remove at least one reel from the set of first reels in response to the trigger event occurring such that each second reel corresponds to one of the first reels.

30. A gaming system as claimed in claim 22, and wherein the game controller is arranged to substitute the at least one second reel for the plurality of first reels in response to the trigger event occurring, each second reel different to the first reel.

31. A gaming system as claimed in claim 22, and wherein the game controller is arranged to conduct a plurality of second game rounds.

32. A gaming system as claimed in claim 31, and wherein the game controller is arranged to varying the number of second reels during the plurality of second game rounds.

33. A gaming system as claimed in claim 22, and further arranged to conduct each first game round with five reels.

34. A gaming system as claimed in claim 22, and further arranged to conduct at least one second game round with three reels.

35. A gaming system as claimed in claim 22, and further arranged to conduct at least one second game round with one reel.

36. A gaming system for use with a gaming system having a gaming controller, the method comprising:

display means for displaying game outcomes to a player; and means for conducting, via the gaming controller, at least one first game round, said conducting of the at least one first game round comprising selecting symbols for a plurality of first reels for display;

means for conducting, via the gaming controller, at least one second game round in response to a first trigger event occurring in the first game round, wherein the at least one second game round has fewer reels displayed than in the at least one first game round, and wherein said conducting of the at least one second game round comprises selecting symbols for at least one second reel for display;

means for conducting, via the gaming controller, a further game round in response to a second trigger event occurring in the at least one second game round, wherein the further game round has a single reel displayed, and wherein said conducting of the further game round comprises selecting symbols for the single reel for display; and means for determining, via the gaming controller, prizes based on winning combinations formable with the symbols selected in the single reel of the further game round and awarding at least the highest of the determined prizes.

37. A gaming machine comprising:

a cabinet;

a display mounted within the cabinet for displaying play of a game to a player; and at least one input device mounted to the cabinet at a position where the player can view the display while operating said at least one input device, said at least one input device operable to input an instruction to initiate a play of a game; and a game controller comprising a processor and a memory storing game instructions, the game controller in data communication with said at least one input device and operating in response receipt of the instruction to initiate a play 1) to conduct at least one first game round by selecting symbols of a plurality of first reels for display on the display, 2) to conduct at least one second game round in response to a first trigger event occurring in the at least one first game round, wherein the at least one second game round has fewer reels displayed than in the at least one first game round, and wherein said conducting of the at least one second game round comprises selecting symbols for at least one second reel for display on the display, 3) to conduct a further game round in response to a second trigger event occurring in the at least one second game round, wherein the further game round has a single reel displayed, and wherein said conducting of the further game round comprises selecting symbols for the single reel for display, and 4) to determine prizes based on winning combinations formable with the symbols selected in the single reel of the further game round and awarding at least the highest of the determined prizes.

* * * * *

UNITED STATES PATENT AND TRADEMARK OFFICE

CERTIFICATE OF CORRECTION

PATENT NO. : 8,469,795 B2
APPLICATION NO. : 12/435150
DATED : June 25, 2013
INVENTOR(S) : Langille It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 555 days.

Signed and Sealed this
Twenty-seventh Day of January, 2015

Michelle K. Lee

Michelle K. Lee
*Deputy Director of the United States Patent and Trademark Office*